United States Patent [19]

Elliott et al.

[11] 4,262,747

[45] Apr. 21, 1981

[54] IN SITU RECOVERY OF GASEOUS HYDROCARBONS AND STEAM

[76] Inventors: Guy R. B. Elliott, 103 Grand Canyon Dr.; Nicholas E. Vanderborgh, 660 Los Pueblos, both of Los Alamos, N. Mex. 87544; Milton W. McDaniel, P.O. Box 488, Cimarron, N. Mex. 87714

[21] Appl. No.: 15,360

[22] Filed: Feb. 26, 1979

[51] Int. Cl.[3] ..... E21B 43/00; E21B 43/38; E21B 43/40

[52] U.S. Cl. ..... 166/305 R; 166/265; 166/314

[58] Field of Search ..... 166/281, 283, 268, 275, 166/305 R, 308, 314, 265; 175/61

[56] References Cited

U.S. PATENT DOCUMENTS

| | | | |
|---|---|---|---|
| 1,067,868 | 7/1913 | Dunn | 166/268 X |
| 2,548,059 | 4/1951 | Ramsey | 166/268 X |
| 3,500,914 | 3/1970 | Petteway | 166/268 |
| 3,654,992 | 4/1972 | Harnsberger et al. | 166/281 |
| 3,782,468 | 1/1974 | Kuwada | 166/314 X |
| 4,040,487 | 8/1977 | Cook, Jr. et al. | 166/314 |
| 4,042,034 | 8/1977 | Cook, Jr. et al. | 166/314 |
| 4,089,374 | 5/1978 | Terry | 166/314 X |
| 4,090,564 | 5/1978 | Cook, Jr. et al. | 166/314 |
| 4,116,276 | 9/1978 | Cook, Jr. et al. | 166/314 |
| 4,131,161 | 12/1978 | Lacquement | 166/314 X |
| 4,149,596 | 4/1979 | Richardson et al. | 166/314 X |
| 4,149,598 | 4/1979 | Christian | 166/314 |

OTHER PUBLICATIONS

Jones, P. H., "Natural Gas Resources of the Geopressured Zones in the Northern Gulf of Mexico Basin", *Natural Gas from Unconventional Sources,* Board of Mineral Resources, Commission on Natural Resources, National Academy of Sciences, Washington, D.C., 1976.

*Primary Examiner*—James A. Leppink
*Assistant Examiner*—George A. Suchfield
*Attorney, Agent, or Firm*—Paul D. Gaetjens

[57] ABSTRACT

In situ (subsurface) methods and devices are described for releasing gaseous hydrocarbons and steam from solution in water or brine, from captured bubbles in formation pores, and from hydrate deposits. With geopressured brines the volume of the brine is reduced so that its volume is less than the sandstone pore volume which holds the brine; at this point the reservoir creates a gas cap of methane and steam which can be produced. Gas caps are formed in natural domes, artificial domes are developed, down-hole engines and pumps are powered both by in situ forces and by surface-generated forces; all are described.

3 Claims, 8 Drawing Figures

FIG. 3a
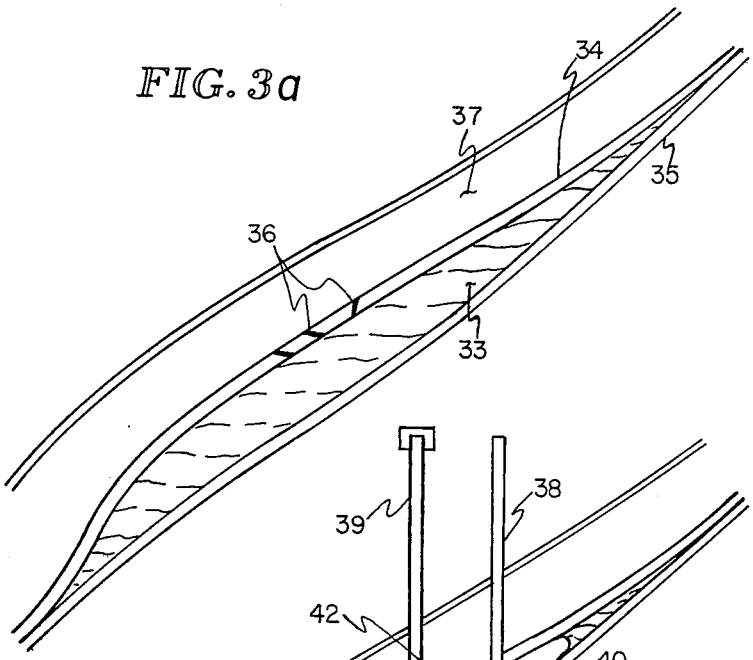
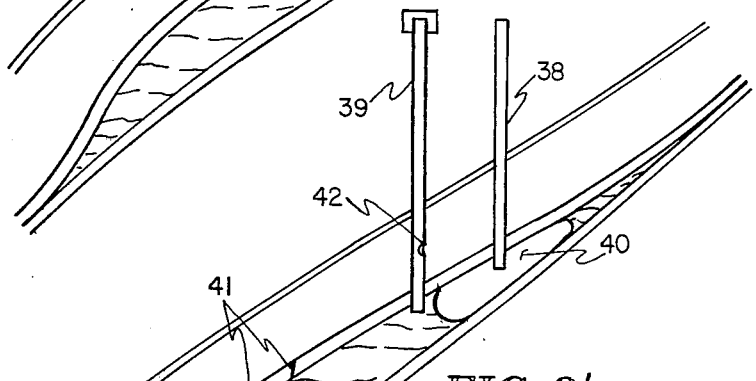
FIG. 3b
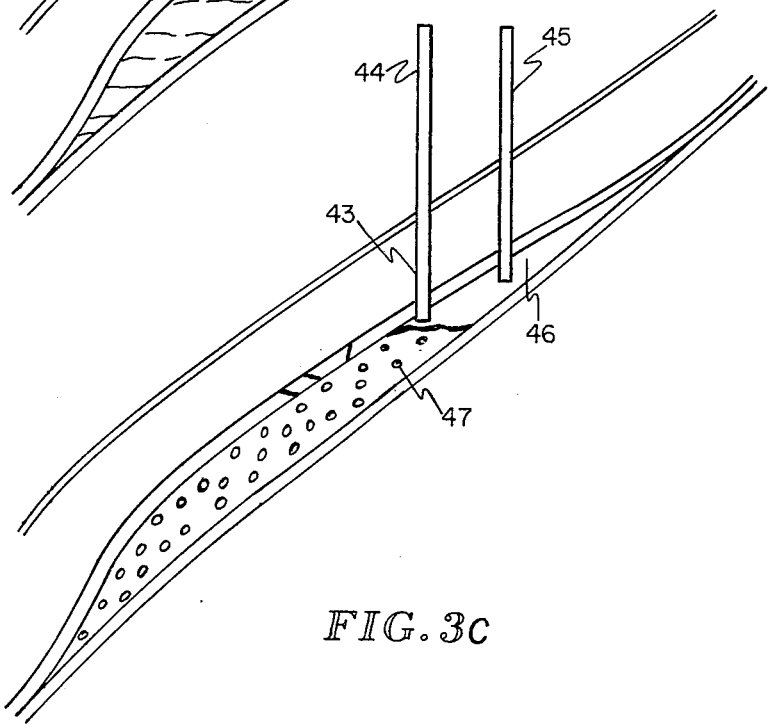
FIG. 3c

IN SITU RECOVERY OF GASEOUS HYDROCARBONS AND STEAM

BACKGROUND OF THE INVENTION

1. Field of the Invention

Some natural subsurface waters (fresh or salty) at high pressures (geopressured or hydrostatic) contain dissolved methane and other constituents of natural gas in commerically useful concentrations. These natural gas constituents may be dissolved in the waters, held as gas bubbles which have been entrapped in porous sandstone or shale, or occur as solid hydrocarbon hydrates. For simplicity in our following descriptions, the term "brine" defines subsurface water solutions, "methane" defines hydrocarbon-gas mixtures which are being delivered from the brines, and "sandstone" defines porous solid formations which hold the brine. This invention encompasses a method and the devices for releasing methane from the natural gas constituents listed above through the use of methane ebullition brought about by pressure reduction, plus methane sweeping in which bubbles of steam or other gases carry off methane as they move up through the brine. A critical aspect of this invention is that the processes are carried out in situ (subsurface) so that the environmentally troublesome brine is never brought to the surface in order to accomplish the methane recovery. Likewise, steam can be recovered in situ in certain cases for which surface processing of brine would normally be required e.g., with geopressured brines. The pressure is lowered by pumps as brine is withdrawn from the sandstone, processed for methane and steam recovery, and reinjected into sandstone elsewhere; alternatively the pressure beneath a dome (natural, or artificially created as in this patent) in a region of geopressured can be reduced so that the whole originally geopressured brine reservoir can deliver its methane and steam to surface facilities. New subsurface engines and pumps which utilize energy both from natural in situ forces and from surface engines are described. These devices allow energy-efficient recovery of the methane and steam, and offer the possibility of electric power generation subsurface for down-hole devices.

2. Prior Art

A. "Natural Gas Resources of the Geopressured Zones in the Northern Gulf of Mexico Basin," pp. 17–33, by P. H. Jones in "Natural Gas from Unconventional Sources," Board of Mineral Resources, Commission on Natural Resources, National Academy of Sciences, Washington, DC, 1976. Jones recognizes the variation of methane solubility with water pressure, the importance of deep hydrocarbons as a source of methane, and the possibility of generating artificially filled gas reservoirs at natural domes (p. 29). Jones proposes that suitable conditions for such artificial filling would be created if pressures in the sandstone were dropped some 50% by drawing brine to the surface (p. 6), and suggests a way to search for the artificial gas caps after they had been created (p. 29). However, Jones does not identify means to develop artificial gas caps other than by bringing large amounts of brine to the surface, and he does not propose the creation of artificial domes for gas collection.

B. "Method for Increasing the Recovery of Natural Gas from a Geo-Pressured Aquifer," Cook, Jr., et al., U.S. Pat. Nos. 4,040,487 and 4,042,034, Aug. 9 and 16, 1977. These inventors recognize the value of reducing brine pressures in sandstone reservoirs to release methane within the reservoirs, but the method they propose requires bringing large amounts of brine to the surface, and the method recovers 14% or less (their calculations) of the methane present initially in the brine they process. By contrast the process of this invention could produce up to 80% of the methane present.

SUMMARY OF THE INVENTION

In situ (subsurface) recovery of methane and steam from high-pressure brines is accomplished by reducing the pressure over the brines with corresponding removal of methane through ebullition and through sweeping of methane by steam or other carrier gases. Variations of the method and specific devices are applicable for different conditions as follows:

(a) For hydrostatically pressured zones, or for geopressured zones in which subsidence is a problem (e.g., under land or under a brine-laden, compressible shale cap), the brine is stripped of methane and some steam in a well pipe which connects the surface with the formation containing the pressured brine. The in situ recovery is accomplished in a series of steps: Fresh brine is delivered to the well pipe from one region of the sandstone, passed through down-hole pumps which act as engines to do useful work, and lifted up the well pipe along side a standpipe. This work reduces the pressure over the brine and allows methane and steam to be released to the surface, and the depleted brine is delivered to the standpipe to be reinjected into another region of the sandstone. Reinjection is accomplished by a combination of work by the down-hole pumps, the standpipe, and auxiliary power supplied from the surface.

(b) If a suitable geopressured reservoir with natural dome is available, a high pressure gas bubble will be created under the dome and near the top of reservoir by injecting compressed or liquified gases (e.g., air, carbon dioxide, nitrogen, methane) through well pipes. This injected gas bubble is left in place long enough to force some of the brine (under 10% in some cases) from the reservoir and into an adjacent, lower-pressured formation, and then the gas bubble is released through the wells. Release of this bubble, after enough brine has been removed to relieve the liquid compressive stresses upon the remaining brine in this physically isolated, originally geopressured reservoir, will produce low enough pressures so that ebullition and steam-sweeping of the dissolved or entrapped methane will occur. The remaining reservoir brine is now in a condition to deliver up its methane supply using conventional well-production practices.

(c) If no suitable natural dome is available at a geopressured site of interest, then single or series of artificial domes can be created at natural inverted troughs (e.g., at fractures in the cap rock) by hydrofracture using fluids which will establish walls of low permeability across the natural troughs. Such hydrofracture will be carried out from wells drilled into troughs, and these artificial domes can be treated like natural domes.

BRIEF DESCRIPTION OF THE DRAWINGS

FIGS. 3A, B, and C show a geopressured formation that is converted into a low-pressure formation so that methane and steam will be released in situ and form a gas cap under a natural dome.

DESCRIPTION OF THE PREFERRED EMBODIMENT

Figure 1:
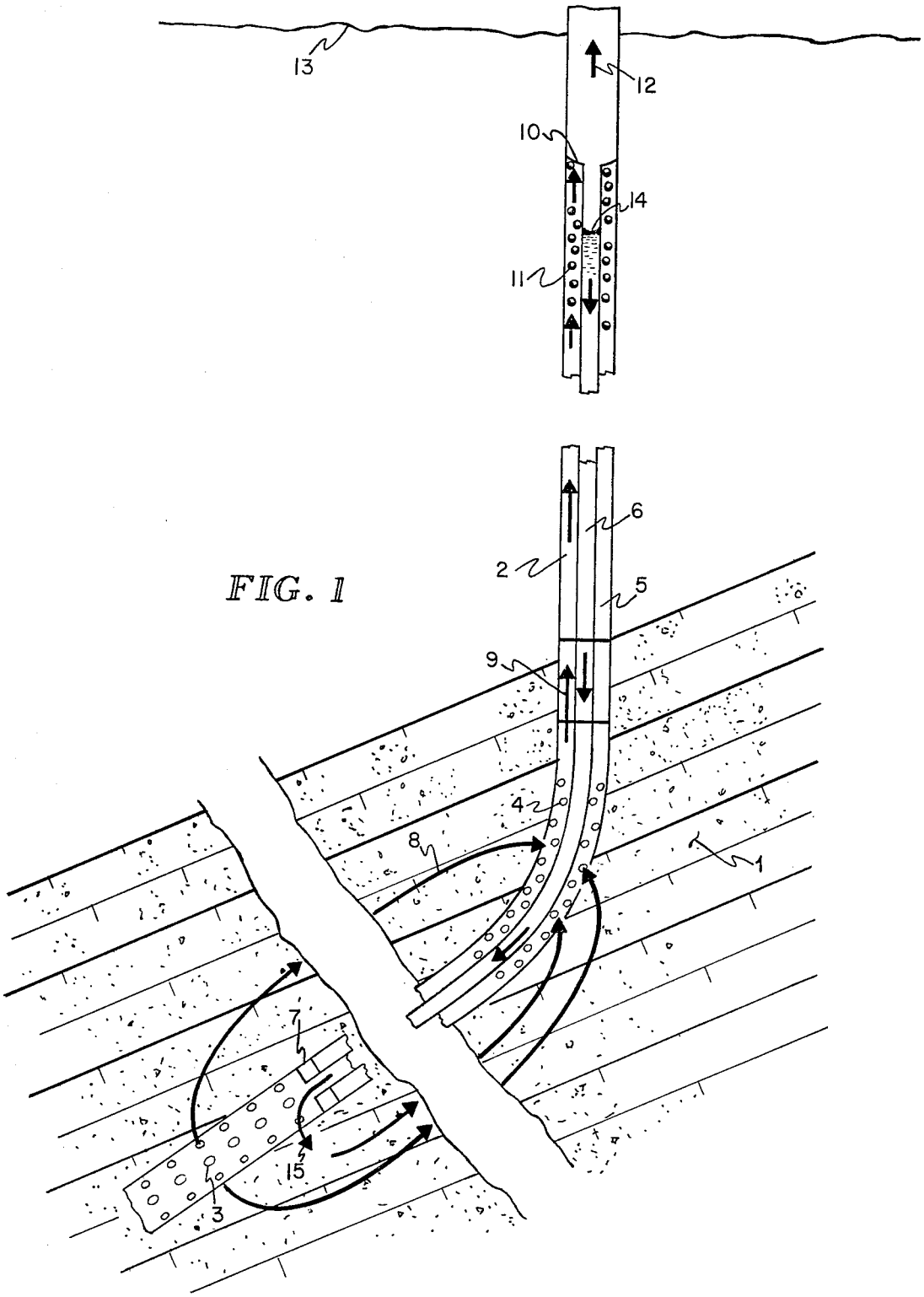
FIG. 1 shows an elevational view of a sandstone formation containing methane and steam in brine and a concurrent reinjection system powered by in situ forces of the depleted brine back into the formation.

FIG. 1 shows the preferred embodiment of this invention where formation pressure is reduced and the methane and steam are recovered in the well pipe while the stripped or depleted brine is returned to the formation. A methane-brine, sandstone formation 1 is penetrated by a directionally drilled well and well pipe 2. The well pipe is perforated 3, 4 at two regions within the formation 1. A spent-brine injection pump 5 is sealed into and closes the well pipe above the upper perforations 4. A standpipe 6 is connected to both ends of the pump and exists through a sealing plug 7 in the well pipe and above the lower perforations 3. Fresh brine flows 8 in the formation and enters the well pipe through perforations 4 and is still essentially at the formation pressure. This brine flows up 9 through the pump 5 where it does pumping work (see FIG. 2) and decreases its pressure as it passes through the pump. Further work is done by the fresh brine as it rises toward the top 10 of the standpipe 6. As the pressure of the brine is reduced, methane-steam bubbles form 11, then escape out of the brine and move 12 toward the surface 13 for commercial recovery. Spent brine 14 flows into the standpipe at low pressure; it passes down the standpipe and through the pump 5 where its pressure is raised above the formation pressure; finally it flows 15 out of the standpipe 6, through perforations 3 and into the formation 1, thus completing the circulation pattern of the brine. The pressure and work to reinject the spent brine arise from three sources: First, the rising fresh brine does pumping work on the spent brine. Second, lifting the brine in the well pipe and into the standpipe both does useful work and reduces the brine volume (methane and steam removal). Third, additional work can be supplied as needed from surface engines through hydraulic lines (not shown), but most of the work of reinjection will be supplied by in situ forces.

Figure 2:
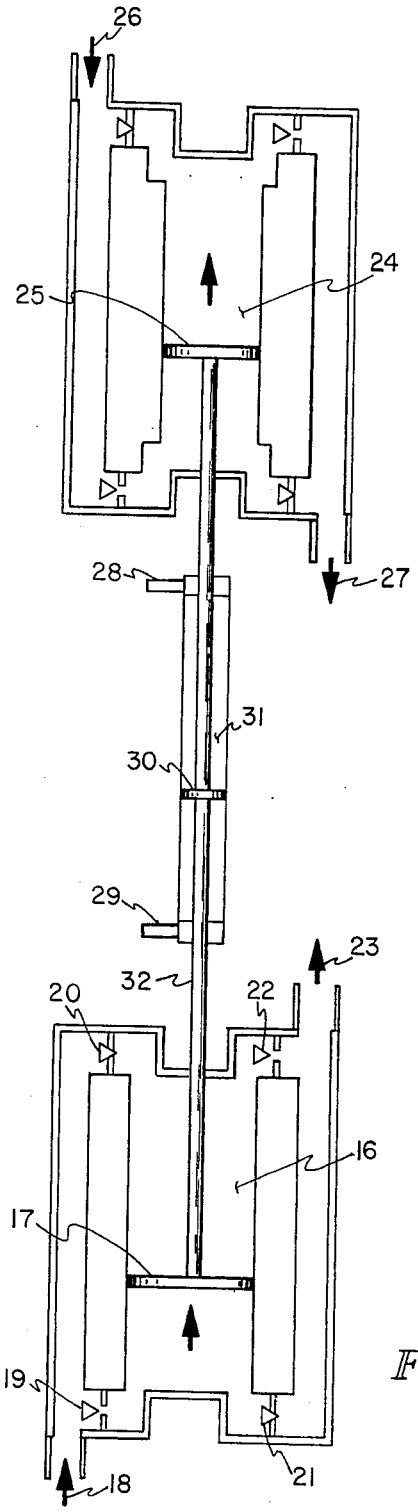
FIG. 2 schematically shows a pump design which utilizes energy jointly or separately as derived from in situ or surface sources.

FIG. 2 shows a schematic design of a pump which is powered in part or completely by subsurface forces and may be powered as desired in part or completely by forces which are generated by surface engines. This work of the subsurface forces appears both directly in forcing the motion of two pistons and also indirectly in lifting brine into a standpipe whose hydrostatic pressure head assists the motion of the pistons. These pistons, plus a third piston powered by surface engines, supply the energy which reinjects spent brine into its original (or other) formation. Because this spent brine has given up methane and steam, its volume has been reduced relative to the volume of fresh brine. The pump consists primarily of three separate cylinders and three pistons mounted on a single piston rod. One cylinder 16 and its piston 17 withdraw work $w_1$ from geopressured brine as the brine moves up from its original formation. On the upstroke of the piston, as illustrated, fresh brine 18 passes through a feedpipe and through an open valve 19. All valves in the system are operated by hydraulic forces from the surface, with mechanical switching down-hole. The brine cannot bypass the piston because two valves 20, 21 are closed. The brine works against the piston 17, filing the cylinder from below with fresh brine while delivering the upper fresh brine out of valve 22 and into pipe 23 which connects to the upflow portion of the well pipe (not shown). A smaller cylinder 24 and piston 25 sized for the reduced volume of the spent brine accept spent brine 26 from the standpipe 6 (see FIG. 1) and into the lower section of cylinder 24. Work $w_2$ is applied from hydrostatic pressure in the standpipe and against piston 25. Spent brine introduced into the upper section of the cylinder 24 during the previous half-cycle of the engine is now delivered under pressure to the lower section of the standpipe 27 which connects to the brine-sandstone formation from which the brine was originally drawn. Withdrawal will normally be from one region of the reservoir, and reinjection will be in another region, as in FIG. 1. However, multiple or branched well systems for reinjection can also be devised. Work $w_4$ is done in the reservoir in injecting the spent brine. Because all working systems exhibit inefficiency and convert work to heat, in this case $q_1$, it may be necessary to supply additional work, depending upon the reduction of the brine volume and the system efficiency. This additional work $w_3$ is supplied by surface engines which supply hydraulic power through pipes and valves 28, 29 to operate an oil-driven piston 30 in cylinder 31. All three pistons are here, but not necessarily, rigidly connected by a single piston rod 32 which coordinates the overall system. The down-stroke half-cycle is completely analogous to the up-stroke half-cycle except that the positions of all valves are reversed. Through the use of this pumping system, subsurface-powered work $w_1$ from the original flow of the fresh brine, plus further subsurface-powered $w_2$ achieved when brine was lifted into the sandpipe, plus surface-powered work $w_3$, combine to supply the work $w_4$ needed to reinject the brine into its original (or other) formation, and to replace the inefficiency losses $q_1$. For pumps with equal 5-inch inside-diameter cylinders and 12-foot piston strokes, moving through 15 up-down strokes per minute, this pump will deliver 350 gallons per minute up-pipe and will reinject the spent brine. If the spent brine cylinder 24 is replaced by an electric generator driven by the piston rod 32, then the system generates electric power down hole from in situ forces.

FIG. 3A shows the ideal conditions for application of the concepts involved in this patent to a geopressured zone. A porous sandstone holds geopressured, geothermal brine 33 between impermeable upper 34 and lower 35 shale beds. Methane generation from hydrocarbons in the shale 35 has saturated the brine above itself and also methane bubbles have become entrapped in the sandstone pores. Small cracks 36 can open through the cap rock if the reservoir pressure exceeds its original geopressure, and brine will be released to the hydrostatic pressure region 37.

FIG. 3B shows the penetration of the geopressured, geothermal reservoir by a well 38. If desired, additional wells 39 can be drilled. Compressed or liquified gas is pumped into the geopressured reservoir to create a gas bubble 40. The gas bubble forces brine to flow out of the geopressured region, through cracks 41, and into the hydrostatic pressured region in the second reservoir 37. Brine can also be delivered to the hydrostatic region through perforations 42 in capped well 39. Ideally, the amount of gas pumped in will displace about 1.5% of the reservoir brine to allow for later expansion of the brine itself when the pressure is reduced.

FIG. 3C shows the result of releasing the bubble pressure after brine has flowed out of the geopressured reservoir. The perforations 43 in the lower well 44 are plugged and the well is uncapped. Both wells 44, 45 deliver methane from gas cap 46, and additional methane 47 is released from the brine to replenish what is removed out through the wells. In an alternative technique the gas cap 46 can be developed without initial injection of a bubble by delivering brine from the reservoir to the well pipe, removing its available methane and steam in the well pipe by techniques of FIG. 1, and reinjection of the remaining brine back into formation. Under these conditions, the brine volume will have been reduced by about 15%, and eventually the volume of the brine in the reservoir will be less than the pore volume of the sandstone, thereby again creating conditions for release of methane and steam into a gas cap over the liquid brine.

Figure 4A:
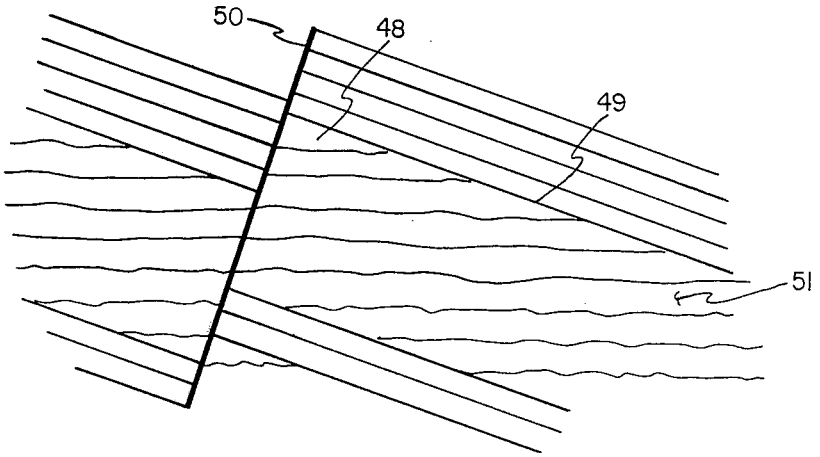
FIGS. 4A, B, and C show an artificial dome created in a natural, inverted trough and used to entrap methane and steam as in FIG. 3.

FIG. 4A shows a natural inverted trough 48 formed by the bottom surface 49 of an impermeable formation and a fault 50 through that formation. Below the fault there is a methane-containing brine 51.

Figure 4B:
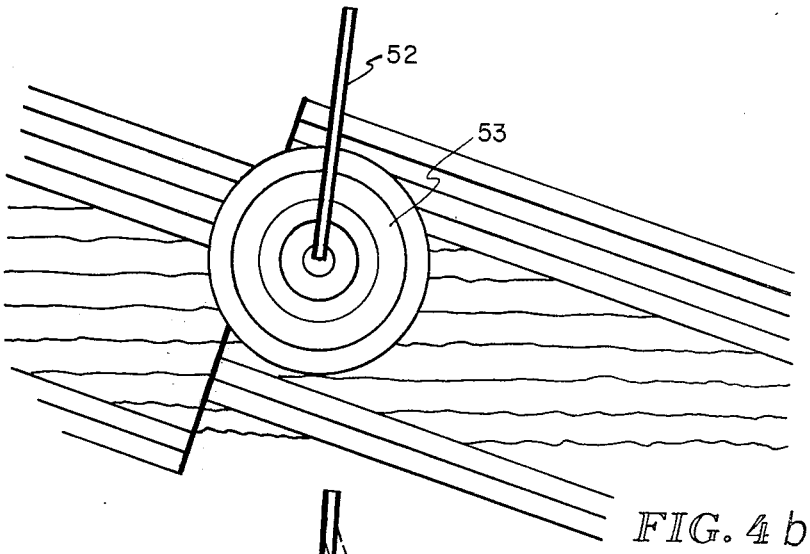

FIG. 4B shows the creation of an artificial dome in the inverted trough. A well 52 has been drilled into the trough, and it has penetrated near the peak of the trough. Now a disk-shaped crack 53 is formed out from the well pipe by hydrofracture. Such a crack will normally lie more or less vertical, and the occurrence of natural faulting will usually have altered the local stress fields so that an additional crack will define a dome. The fluid used for hydrofracturing will create an impermeable wall through which brine or methane cannot readily pass; possible hydrofracture fluids include but are not restricted to clays, cements, thickners, precipitants, and oils. The direction of the hydrofracture can be influenced by the placement of branched or multiple drill holes (not shown).

Figure 4C:
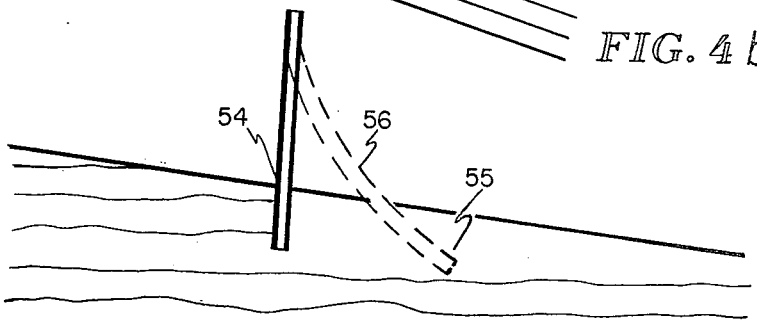

FIG. 4C shows a 90° rotation of FIG. 4B. Here the wall formed by hydrofracture 54 forms the third wall (including the fault 50 and the formation surface 49 of FIG. 4A as the other two walls) of a dome 55 in which methane can be collected. Deviated drilling 56 from the original well is shown penetrating the dome, but more usual well-penetration techniques can also be used to connect the well pipe to the dome. Normally a cascade of such domes will be created along an inverted trough both to increase the volume available for gas storage and to provide backup in case the dome formation has failed in one or more of the attempts.

Thus in this invention, a method and devices are described for in situ release of methane and steam from solution in natural brines. This release may be in well pipes or into domes, either natural domes or domes which have been created by the techniques described in this invention. The pump for reinjection of spent brine (i.e., brine depleted in methane and steam) is powered in large part by in situ forces, and this use of such forces is an integral and essential component of economic in situ release of the methane and steam. A simple modification of this pump allows the work derived from the in situ forces to appear as electric power for down-hole use. Pumping with brine reinjection (as opposed to release of methane-steam into a dome) will normally be the technique employed if (a) the pressures within the methane-containing brine are hydrostatic, (b) if subsidence is a problem, (c) if the geopressured reservoir of interest lies partially or completely under land, or (d) if no dome is available. However, where a geopressured dome is available or can be constructed, and where the environmental conditions are right, then the technique of releasing pressure within a whole, geopressured reservoir offers a very thorough recovery of a very large resource.

What we claim is:

1. An in situ method of extracting methane and steam from brine under high pressure comprising:

(a) emplacing at least one well pipe into a brine-containing formation, (b) perforating the well pipe in at least two locations opposite the said formation forming upper and lower perforations, (c) having a pump in the well pipe near the upper perforations, (d) circulating the brine through a first section of the said pump thereby reducing its pressure, recovering mechanical energy to assist pumping, controlling the release of the methane and steam to the surface, and (e) pumping methane-depleted brine into the formation.

2. The method of claim 1 in which the pumping of the methane-depleted brine comprises flowing the brine from a first section of the pump, into a standpipe, through a second section of the pump, and injecting the brine through the lower perforations into the formation.

3. The method of claim 1 in which the methane-containing brine is extracted from the lower perforations and is returned to the formation through the upper perforations.

* * * * *